US007659864B2

(12) United States Patent
Chen et al.

(10) Patent No.: US 7,659,864 B2
(45) Date of Patent: Feb. 9, 2010

(54) BROADBAND ANTENNA

(75) Inventors: Wen-Shyang Chen, Hsin-Tien (TW); Yao-Yuan Chang, Hsin-Tien (TW); Chih-Ren Hsiao, Hsin-Tien (TW); Tsung-Wen Chiu, Hsin-Tien (TW); Fu-Ren Hsiao, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/101,549

(22) Filed: Apr. 11, 2008

(65) Prior Publication Data

US 2008/0258980 A1 Oct. 23, 2008

(30) Foreign Application Priority Data

Apr. 20, 2007 (TW) ..... 96113999 A

(51) Int. Cl.
*H01Q 1/50* (2006.01)
*H01Q 9/30* (2006.01)

(52) U.S. Cl. ..... 343/860; 343/700 MS; 343/731; 343/732

(58) Field of Classification Search ..... 343/860, 343/731
See application file for complete search history.

(56) References Cited

U.S. PATENT DOCUMENTS

| | | | | |
|---|---|---|---|---|
| 6,081,242 | A | 6/2000 | Wingo | |
| 6,094,172 | A * | 7/2000 | Koscica et al. | 343/731 |
| 6,396,458 | B1 * | 5/2002 | Cockson et al. | 343/860 |
| 7,394,428 | B1 * | 7/2008 | Hsieh | 343/700 MS |
| 2002/0175878 | A1 * | 11/2002 | Toncich | 343/860 |
| 2007/0052593 | A1 * | 3/2007 | Bateman et al. | 343/700 MS |
| 2007/0262902 | A1 * | 11/2007 | Iwata et al. | 343/700 MS |

* cited by examiner

*Primary Examiner*—Trinh V Dinh
(74) *Attorney, Agent, or Firm*—patenttm.us

(57) ABSTRACT

A broadband antenna has a substrate, a coupling conductor, a conductor string, a ground conductor and a ground plane. The coupling conductor has a first coupling member and a second coupling member being separated from each other. The conductor string and the ground conductor are connected to the second coupling member. The conductor string extends along a direction opposite to the second coupling member. The ground conductor is connected to the ground plane. The broadband antenna uses the coupling conductor and the ground conductor to adjust input impedance for impedance match. The conductor string functions as a multi level resonance circuit to increase impedance bandwidth.

15 Claims, 7 Drawing Sheets

BROADBAND ANTENNA

BACKGROUND OF THE INVENTION

1. Field of the Invention

The present invention relates to an antenna, and more particularly to a broadband antenna that has multiple radiation conductors connected in series as a conductor string.

2. Description of Related Art

Wireless Communication technologies develop rapidly in recently years and various wireless products are marketed popularly. One of most important components in wireless product is an antenna. The design of the antenna requires stricter criteria than the past in size and performance aspects. Taking account of the appearance and size of wireless products, miniature antennas for those products are necessary. Accordingly, the monopole antenna utilizing a metallic ground plane to replace a negative radiator is developed. The monopoly antenna achieves superior radiation effects with a shorter length, i.e. a half of that of a dipole antenna. Subsequent to the monopole antenna, fabricators develop a folded monopole antenna with bent metallic strips to further miniature the size of the antenna and solve the problem of blind area.

With reference to FIG. 1, an antenna matching circuit is disclosed in U.S. Pat. No. 6,081,242 and comprises a printed circuit board (10) with a surface (101), a first inductor (102), a capacitor (103), a second inductor (104), a connection pad (105) and a ground plane (106). The connection pad (105) is formed on the surface of the printed circuit board (10) and coupled to the first inductor (102). The capacitor (103) is formed between the first inductor (102) and the second inductor (104). The second inductor (104) is further coupled to the ground plane (106). With zigzag traces constituting the inductors (102)(104), the antenna matching circuit has higher coupling efficiency and a shorter length. However, such an antenna matching circuit does not support multi level resonance and its impedance bandwidth is also limited. Further, the input impedance of the antenna matching circuit cannot be adjusted to achieve required impedance match.

To overcome the shortcomings, the present invention provides a broadband antenna to mitigate or obviate the aforementioned problems.

SUMMARY OF THE INVENTION

The main objective of the invention is to provide a broadband antenna that uses a coupling conductor and a ground conductor to adjust input impedance of the antenna, whereby the impedance variation of the antenna is smoother and superior antenna characteristics including impedance match and operating bandwidth are achieved.

Another objective of the invention is to provide a broadband antenna that has multiple radiation conductors connected in series as a multi level resonance circuit to increase impedance bandwidth of the antenna.

Another yet objective of the invention is to a broadband antenna that has a ground conductor in a zigzag pattern to have a long effective resonance length, decrease resonance frequency and reduce the size of the antenna.

To accomplish the objectives, the broadband antenna has a substrate, a coupling conductor, a conductor string, a ground conductor and a ground plane. The coupling conductor has a first coupling member and a second coupling member being separated from each other. The conductor string and the ground conductor are connected to the second coupling member. The conductor string extends along a direction opposite to the second coupling member. The ground conductor is connected to the ground plane.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
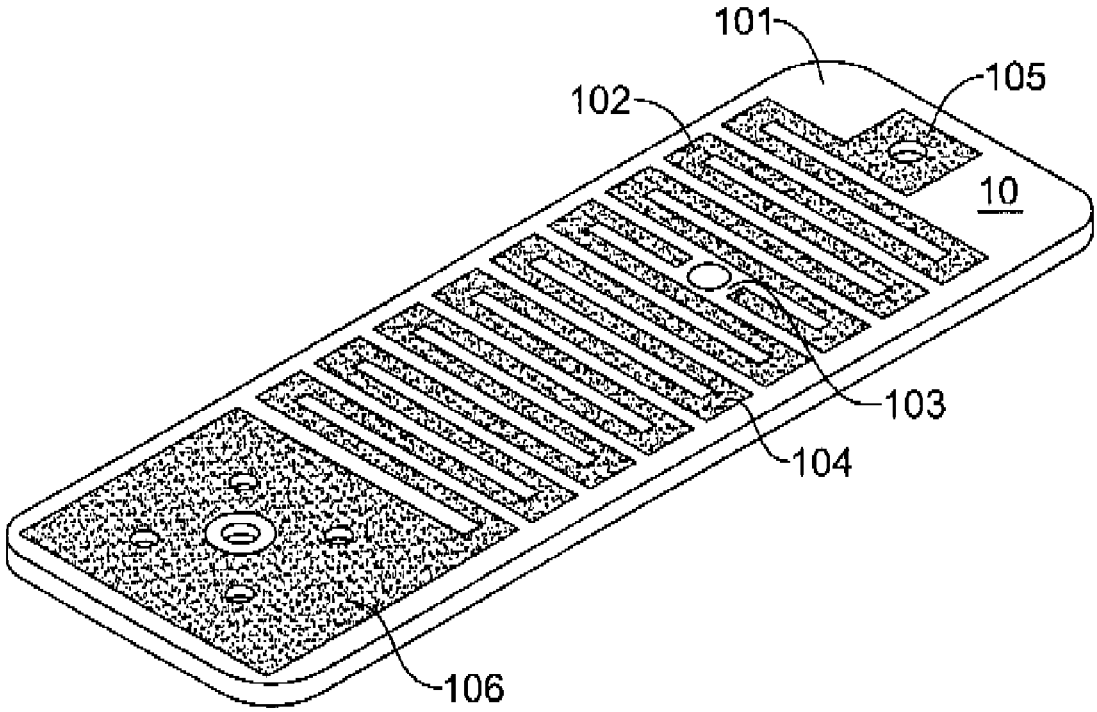
FIG.1 PRIOR ART
FIG. 1 is a perspective view of an antenna matching circuit in accordance with the prior art.
Figure 2A:
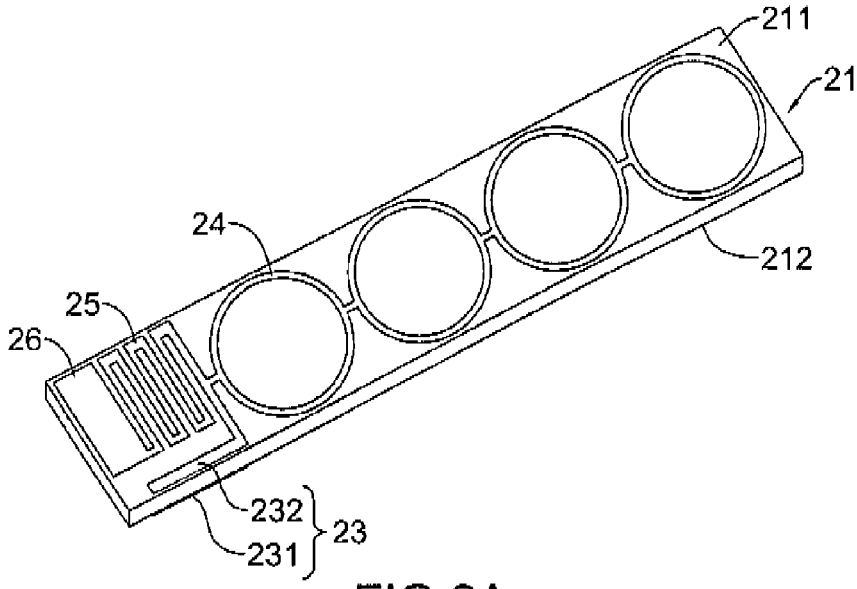
FIG. 2A is a perspective view of a first embodiment of a broadband antenna with annular conductors connected in series in accordance with the present invention.
Figure 2B:
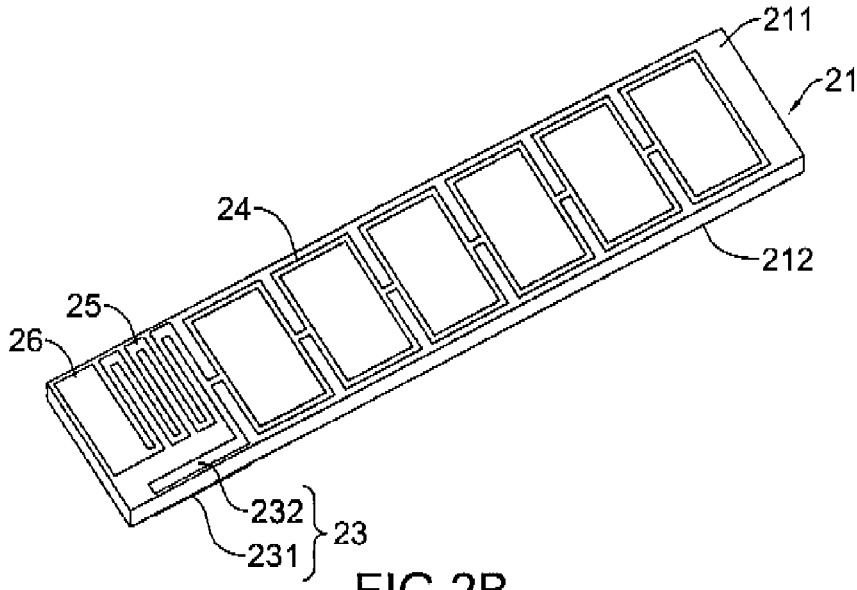
FIG. 2B is a perspective view of a second embodiment of a broadband antenna with rectangular ring-shaped conductors connected in series in accordance with the present invention.
Figure 2C:
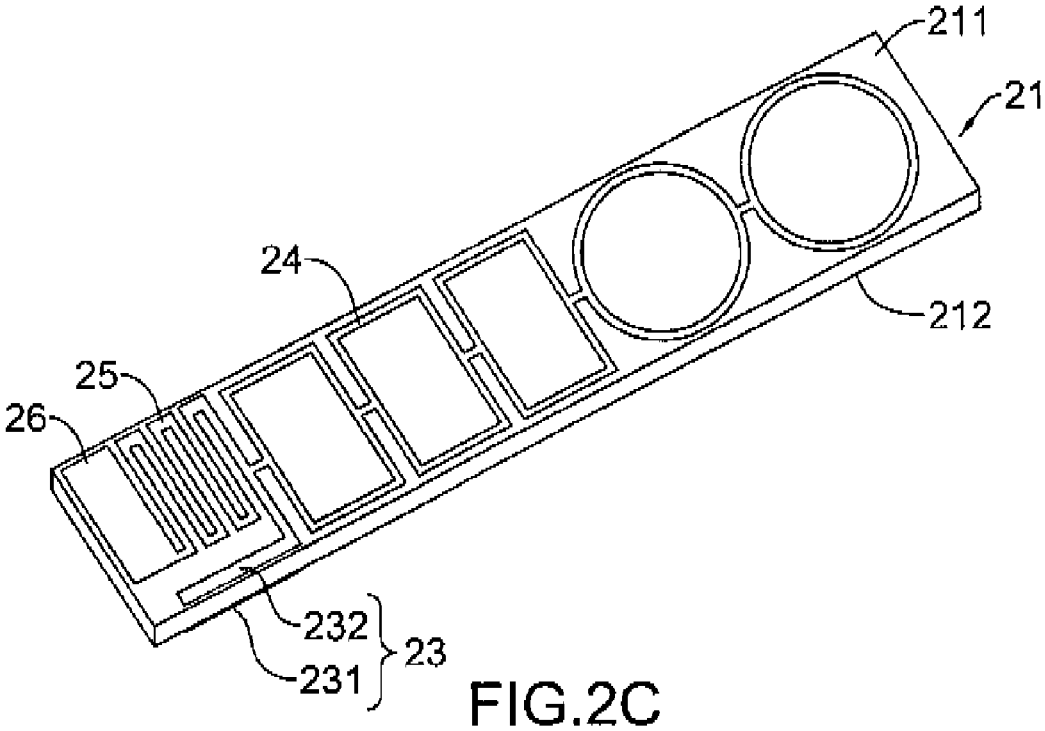
FIG. 2C is a perspective view of a third embodiment of a broadband antenna with annular and rectangular ring-shaped conductors connected in series in accordance with the present invention.

With reference to FIGS. 2A to 2C, a broadband antenna in accordance with the present invention comprises a substrate (21), a coupling conductor (23), a conductor string, a ground conductor (25) and a ground plane (26).

The substrate (21) has a top surface (211) and a bottom surface (212) with a thickness, a length and a width. The thickness is about 0.5 millimeter (mm), the length is about 109 mm and the width is about 10 mm.

The coupling conductor (23) is equivalent to a capacitive element and has a first coupling member (231) and a second coupling member (232) being separated by a distance.

The first coupling member (231) is formed on the bottom surface (212) of the substrate (21) and has a length and a width being approximately 19 mm and 1 mm respectively. The second coupling member (232) is formed on the top surface (211) of the substrate (21) and has a length and a width being approximately 17 mm and 1 mm respectively. The distance between the first coupling member (231) and the second coupling member (232) is equal to the thickness of the substrate (21).

The conductor string is formed by multiple conductors (24) connected in series. The conductor string has one end connected to the second coupling member (232) and extends along a direction opposite to the second coupling member (232). The conductor string has a length about 89 mm and a width about 9.5 mm. The multiple conductors (24) may be annular or rectangular ring-shaped. Alternatively, a part of the multiple conductors (24) may be annular and remains of the multiple conductors (24) may be rectangular ring-shaped.

Each of the annular conductors (24) has a diameter about 9.5 mm. Each of the rectangular ring-shaped conductors (24) has a length about 9.5 mm and a width about 8 mm.

The ground conductor (25) has a first end a second end. The first end is connected to the conductor string and the second coupling member (232) of the coupling conductor (23). The ground conductor (25) is formed by a longitudinal conductive strip with a total length about 45 mm and is arranged on the substrate (21) in a zigzag pattern. The zigzag pattern has a length about 18 mm and a width about 7.5 mm.

The ground plane (26) is connected to the second end of the ground conductor (25) and has a length about 2 mm and a width about 7.5 mm.

Figure 3:
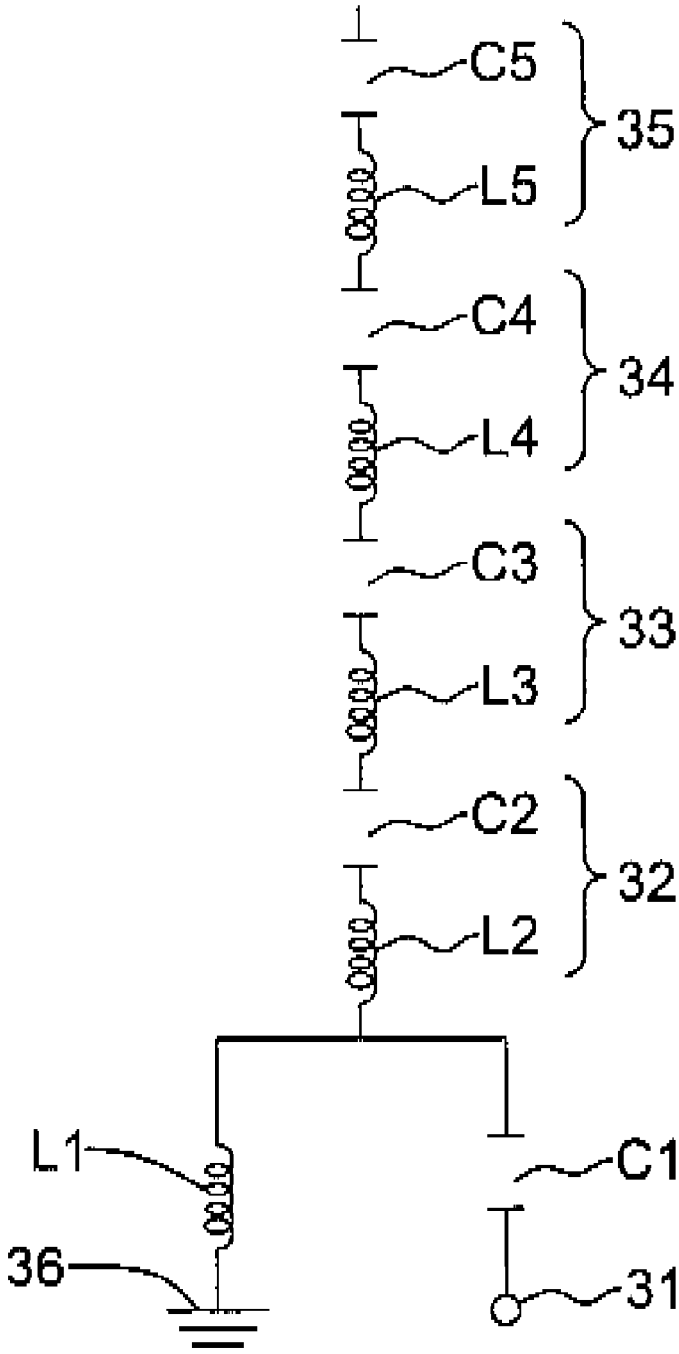
FIG. 3 is an equivalent circuit of the broadband antennas in FIGS. 2A to 2C.

With reference to FIG. 3, an equivalent circuit of the broadband antenna in FIGS. 2A to 2C comprises multiple a signal feeding port (31), a ground (36) and multiple resonance units (32-35).

The multiple conductors (24) as a whole function as a multi-order resonance circuit to increase the impedance bandwidth of the antenna. Each of the conductors (24) is equivalent to a resonance units (32-35) composed of a capacitor unit (C2-C5) and an inductor units (L2-L5). The first level resonance unit (32) comprises a second capacitor unit (C2) and a second inductor unit (L2). The second level resonance unit (33) comprises a third capacitor unit (C3) and a third inductor unit (L3). The third level resonance unit (34) comprises a fourth capacitor unit (C4) and a fourth inductor unit (L4). The fourth level resonance unit (35) comprises a fifth capacitor unit (C5) and a fifth inductor unit (L5).

The coupling conductor (23) and the ground conductor (25) are respectively equivalent to a first capacitor unit (C1) and a first inductor unit (L1).

The signals are received by the signal feeding port (31), transmitted to the multi-level resonance circuit through the first capacitor unit (C1) and also transmitted to the ground (36) through the first inductor unit (L1). The capacitor unit (C1) and the first inductor unit (L1) are used to adjust impedance match of the broadband antenna thus obtaining a satisfactory operating bandwidth.

Figure 4:
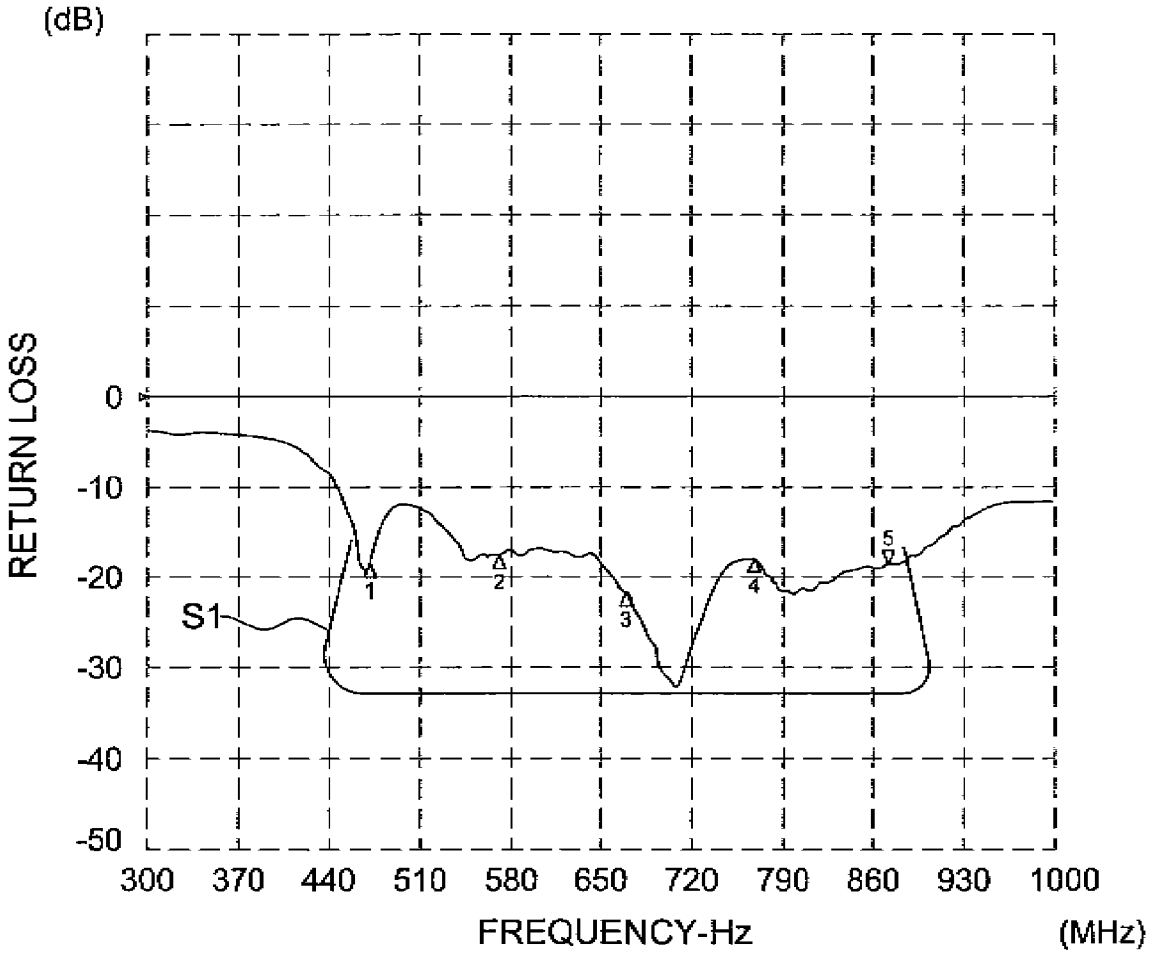
FIG. 4 is a diagram showing return loss characteristics of the broadband antenna in FIGS. 2A-2C.

With reference to FIG. 4 when the broadband antenna in accordance with the present invention is operated in a with the return loss 10 dB, the antenna has an operating bandwidth S1 about 420 MHz (from 450 MHz to 870 MHz). The operating bandwidth S1 is wide enough and applicable to many wireless systems such as an ultra high frequency (UHF) system. Adding the multiple conductors (24) as the multi level resonance circuit in the antenna effectively broadens the operating bandwidth S1. Further, using the capacitor unit (C1) and the first inductor unit (L1) to adjust the input impedance, the antenna characteristics such as impedance match and operating bandwidth are more satisfactory.

Figure 5:
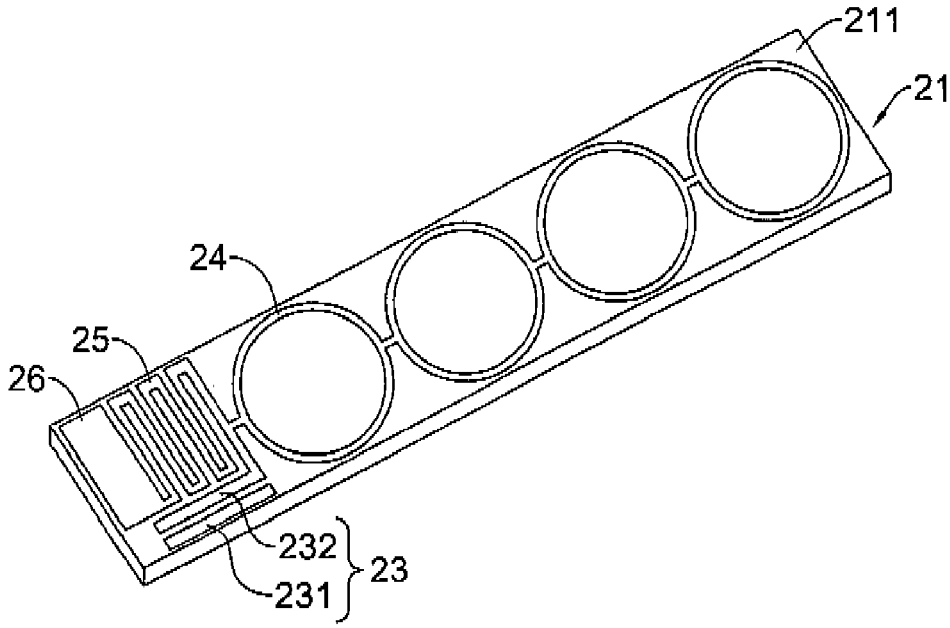
FIG. 5 is a perspective view of a fourth embodiment of a broadband antenna in accordance with the present invention.

With reference to FIG. 5, the fourth embodiment is substantially the same as the foregoing embodiments, but differs in the coupling conductor (23). The first coupling member (231) and the second coupling member (232) are all formed on the top surface (211) of the substrate (21). The second coupling member (232) is apart from the first coupling member (231) by a distance. The modification of the coupling conductor (23) in this embodiment increases an effective coupling area to enhance capacitive coupling effects and improve impedance match.

Figure 6:
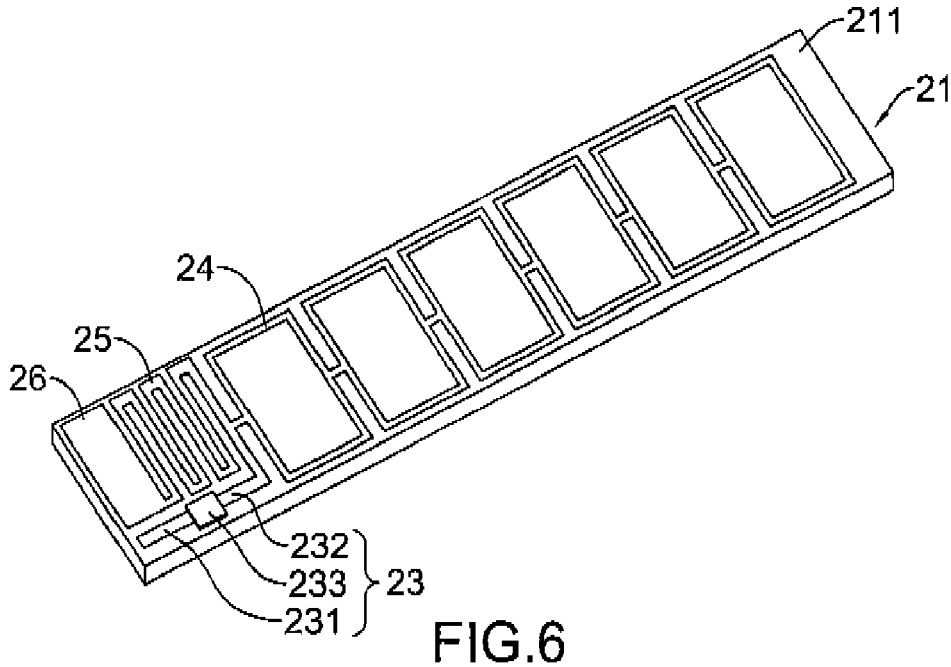
FIG. 6 is a perspective view of a fifth embodiment of a broadband antenna in accordance with the present invention.

With reference to FIG. 6, the fifth embodiment is similar to the fourth embodiment but further comprises a capacitor (233) electrically mounted between the first coupling member (231) and the second coupling member (232). The capacitor (233) may be mounted on the substrate (21) by soldering. The signal is transmitted from the first coupling member (231) to the second coupling member (232) through the capacitor (233). With the capacitor (233), the capacitance of the coupling conductor (23) is adjusted to have a larger capacitive coupling factor and a lower resonance frequency.

Figure 7:
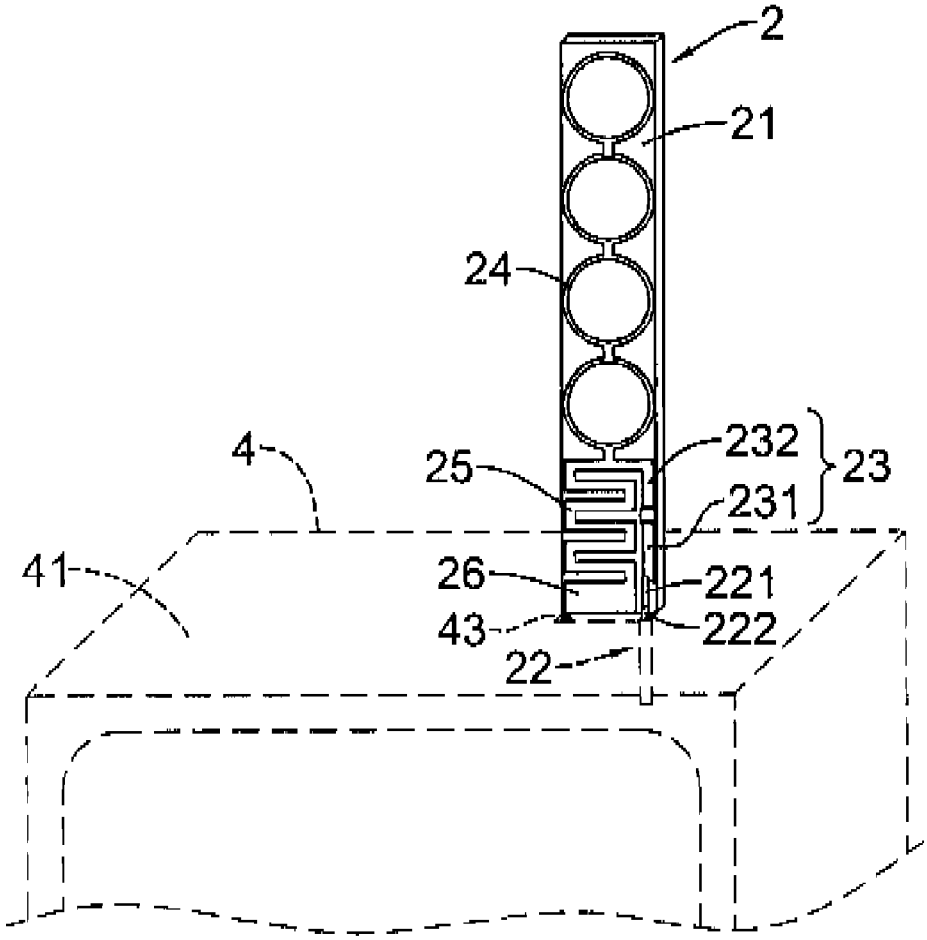
FIG. 7 is an operation view of the broadband antenna in FIG. 6 being applied in an electronic device.

With reference to FIG. 7, the broadband antenna (2) of FIG. 6 is applied to an electrical device (4) having a top surface (41) and a ground terminal (43). A feed cable (22) with a positive segment (221) and a negative segment (222) may be used to connect the broadband antenna (2) to the electrical device. When the broadband antenna (2) is mounted on the electrical device (4), the ground plane (26) is correspondingly connected to the ground terminal (43) and the conductor (23) keeps apart from the electrical device (4). The positive segment (221) is electrically connected to the first coupling member (231) while the negative segment (222) is electrically connected to the ground terminal (43). The electrical device may be a notebook computer, a vehicle GPS receiver and other digital products.

The signal is transmitted from the positive segment (221) to the first coupling member (231), coupled to the second coupling member (232) and further transmitted to the multiple conductors (24) and the ground conductor (25). The multiple conductors (24) connected in series functions as a multi level resonance circuit to process the signal. The ground conductor (25) provides inductive effects to conduct the signal to the ground plane (26).

In short, using the coupling conductor (23) to couple signal and using the ground conductor (23) to conduct signal, the input impedance of the antenna is adjusted to have better impedance match characteristics and a wider operating bandwidth. The multiple conductors (24) as the multi level resonance circuit increases impedance bandwidth of the antenna. Because the ground conductor (25) is formed as a zigzag trace with inductor characteristics, the impedance bandwidth of the antenna also can be adjusted by changing the inductance value through controlling the gap, the width or the total length of the zigzag trace. The inductor characteristics and the capacitive coupling effect provided by the coupling conductor (23) make the antenna have good impedance match.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A broadband antenna comprising:

a substrate having a top surface and a bottom surface;

a coupling conductor having a first coupling member and a second coupling member being opposite to and separated from the first coupling member by a distance;

a conductor string formed by multiple conductors connected in series, connected to the second coupling member and extending along a direction opposite to the second coupling member;

a ground conductor having a first end and a second end, the first end being connected to the second coupling member and the conductor string; and a ground plane connected to the second end.

2. The broadband antenna as claimed in claim 1, wherein the coupling conductor is a capacitive element.

3. The broadband antenna as claimed in claim 1, wherein the first coupling member is formed on the top surface of the substrate.

4. The broadband antenna as claimed in claim 1, wherein the second coupling member is formed on the bottom surface of the substrate.

5. The broadband antenna as claimed in claim 1, wherein each of the multiple conductors is annular.

6. The broadband antenna as claimed in claim 1, wherein each of the multiple conductors is rectangular ring-shaped.

7. The broadband antenna as claimed in claim 1, wherein a part of the multiple conductors is annular and remains of the multiple conductors are rectangular ring-shaped.

8. The broadband antenna as claimed in claim 1, wherein the ground conductor is an inductive element.

9. The broadband antenna as claimed in claim 1, wherein the broadband antenna further comprises a feed wire having a negative segment and a positive segment, and the positive segment being connected to the first coupling member.

10. The broadband antenna as claimed in claim 1, wherein the ground conductor is formed by a longitudinal conductive strip arranged in a zigzag pattern.

11. The broadband antenna as claimed in claim 1, wherein the first coupling member is formed on the top surface of the substrate; and the second coupling member is formed on the bottom surface of the substrate.

12. The broadband antenna as claimed in claim 1, wherein the first coupling member and the second coupling member are formed on the top surface of the substrate and separated from each other by the distance.

13. The broadband antenna as claimed in claim 11, wherein the conductor string is formed on the top surface of the substrate.

14. The broadband antenna as claimed in claim 12, wherein the conductor string is formed on the top surface of the substrate.

15. The broadband antenna as claimed in claim 14, wherein the broadband antenna further comprises a capacitor mounted on the top surface of the substrate and connected between the first coupling member and the second coupling member.

* * * * *